US008842047B2

(12) United States Patent
Tseng et al.

(10) Patent No.: US 8,842,047 B2
(45) Date of Patent: Sep. 23, 2014

(54) PORTABLE COMMUNICATION DEVICE AND ADJUSTABLE ANTENNA THEREOF

(71) Applicant: HTC Corporation, Taoyuan County (TW)

(72) Inventors: Chun-Wei Tseng, Taoyuan County (TW); Yu-Meng Yen, Taoyuan County (TW); Ruey-Hsuan Lee, Taoyuan County (TW); Chien-Chih Chen, Taoyuan County (TW); Yen-Liang Kuo, Taoyuan County (TW); Wan-Ming Chen, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 187 days.

(21) Appl. No.: 13/688,221

(22) Filed: Nov. 29, 2012

(65) Prior Publication Data

US 2014/0145892 A1 May 29, 2014

(51) Int. Cl.
*H01Q 1/38* (2006.01)
*H01Q 9/04* (2006.01)

(52) U.S. Cl.
CPC ..... *H01Q 9/0407* (2013.01)
USPC ..... 343/700 MS; 343/702; 343/750

(58) Field of Classification Search
USPC ..... 343/700 MS, 702, 750
See application file for complete search history.

(56) References Cited

U.S. PATENT DOCUMENTS

| | | | | |
|---|---|---|---|---|
| 8,279,121 | B2 * | 10/2012 | Ishizuka et al. | 343/700 MS |
| 8,508,420 | B2 * | 8/2013 | Fujieda et al. | 343/745 |
| 2012/0105292 | A1 * | 5/2012 | Wong et al. | 343/749 |
| 2014/0062796 | A1 * | 3/2014 | Chen et al. | 343/700 MS |

FOREIGN PATENT DOCUMENTS

| | | |
|---|---|---|
| TW | M305968 | 2/2007 |
| TW | M384419 | 7/2010 |
| TW | M395276 | 12/2010 |
| TW | 201138213 | 11/2011 |

* cited by examiner

*Primary Examiner* — Tan Ho
(74) *Attorney, Agent, or Firm* — CKC & Partners Co., Ltd.

(57) ABSTRACT

A portable communication device and an adjustable antenna thereof are disclosed herein. The portable communication device includes a substrate, the adjustable antenna and a control circuit. The adjustable antenna includes an antenna body, an adjusting element, a feeding terminal and a ground terminal. The antenna body has multiple conductive portions and is disposed above the substrate. The adjusting element is coupled between the conductive portions. The feeding terminal and the ground terminal extend from the antenna body and are coupled to the substrate. The control circuit feeds a first control signal and a second control signal respectively through the feeding terminal and the ground terminal to the adjusting element, so as to adjust an electrical length of the adjustable antenna.

18 Claims, 5 Drawing Sheets

PORTABLE COMMUNICATION DEVICE AND ADJUSTABLE ANTENNA THEREOF

BACKGROUND

1. Field of Invention

The present application relates to a communication device and an antenna structure thereof. More particularly, the present application relates to a portable communication device and an adjustable antenna thereof.

2. Description of Related Art

With the rapid development of wireless communication technology, all kinds of portable communication devices are developed and widespread in daily life, such as mobile phones, personal digital assistants (PDA) and tablets. These portable communication devices have become an essential part of modern society.

The antenna component, configured for broadcasting/receiving radio waves and transmitting/exchanging radio data, is one of the most important components within the portable communication device in no doubts. Due to a variety of communication systems and their applications are introduced in recent years, the antenna is required to be designed for multiple bands, so as to cover multiple transmission frequency bands by the same antenna. In addition, because the appearance of the portable communication device tends to be compact, light-weighted and miniaturized, the antenna design is subject to the restrictions on the structural size, and it may increase the difficulties in designing the multi-frequency antenna.

The structure of Planar Inverted-F Antenna (PIFA) is commonly adopted by the portable communication device to implement a multi-frequency antenna, which is complied with requirements (e.g., light-weighted, compact-sized) on the portable communication devices. However, the multi-frequency antenna will be limited by the spacing distances between the antenna body, the ground and the metal frame, and it may further increase the difficulties in designing the multi-frequency antenna.

In addition, different wireless signals utilized by different applications (e.g., voice communication, wireless network, radio broadcasting, digital television, near-field communication) usually have different frequency bands on their own. It is difficult to implement multiple antennas or multiple antenna transceiver terminals corresponding to the individual different bands within the limited space of the portable communication device. Besides, a traditional antenna is hard to dynamically adjust the operating frequency bands since of the fixed characteristics of the antenna itself for the specific bands and the purpose after the assembly.

Some conventional designs provide antenna architectures with adjustable transceiver frequency. However, the adjustable antenna architectures in conventional designs require extra wirings in order to transmit control signals (used for adjusting frequencies) from the substrate to the antenna body or the adjusting units (e.g., switching components, variable capacitors) on the antenna carrier. It is noted that, each switching component requires a pair of wirings for control signals (e.g., one for the input signal and the other for the output signal) for controlling its operating states. The more different operating states required the more wirings for control signals are needed. However, additional wirings and elements may cause the antenna architectures even become more complex, and may also result in additional signal transmission noise.

SUMMARY

In order to solve the aforesaid problem, this disclosure provides a portable communication device and an adjustable antenna thereof. There is an adjusting element (the adjusting element may include two diodes with opposite conductive directions) disposed in the adjustable antenna. Control signals can be fed through a feeding terminal and a ground terminal of the adjustable antenna for controlling the adjusting element (e.g., controlling the conductive states of the diodes), such that an electrical length of the adjustable antenna can be regulated for adjusting frequency on the antenna. In addition, the adjustable antenna may further include a variable capacitive loading, and a capacitance value of the variable capacitive loading can be controlled by a direct-current (DC) biased control signal fed through the feeding terminal, such that the frequency adjustment can be controlled in a smooth and continuous manner. In this case, the frequency adjustment on this adjustable antenna can be realized without extra wirings for transmitting control signals.

Therefore, an aspect of the present application is to provide a portable communication device includes a substrate, an adjustable antenna and a control circuit. The adjustable antenna includes an antenna body, an adjusting element, a feeding terminal and a ground terminal. The antenna body has a plurality of conductive portions. The antenna body is disposed above the substrate. The adjusting element is coupled between the conductive portions. The feeding terminal extends from the antenna body and coupled to the substrate. The ground terminal extends form the antenna body and coupled to the substrate. The control circuit is configured for feeding a first control signal and a second control signal respectively through the feeding terminal and the ground terminal to the adjusting element, so as to adjust an electrical length of the adjustable antenna.

Another aspect of the present application is to provide an adjustable antenna suitable for a portable communication device including a substrate. The adjustable antenna includes an antenna body, a first diode, a second diode, a feeding terminal and a ground terminal. The antenna body has conductive portions. The antenna body is disposed above the substrate. The first diode is coupled between the conductive portions. The second diode is coupled between the conductive portions. The feeding terminal extends from the antenna body and coupled to the substrate. The ground terminal extends form the antenna body and coupled to the substrate. The first diode is located closer to the feeding terminal than the second diode. The first diode and the second diode have opposite conductive directions. Each of a first control signal and a second control signal is respectively fed through the feeding terminal and the ground terminal to the adjustable antenna for controlling conductive states of the first diode and the second diode, so as to adjust an electrical length of the adjustable antenna.

BRIEF DESCRIPTION OF THE DRAWINGS

The invention can be more fully understood by reading the following detailed description of the embodiments, with reference made to the accompanying drawings as follows.

DETAILED DESCRIPTION

Figure 1:
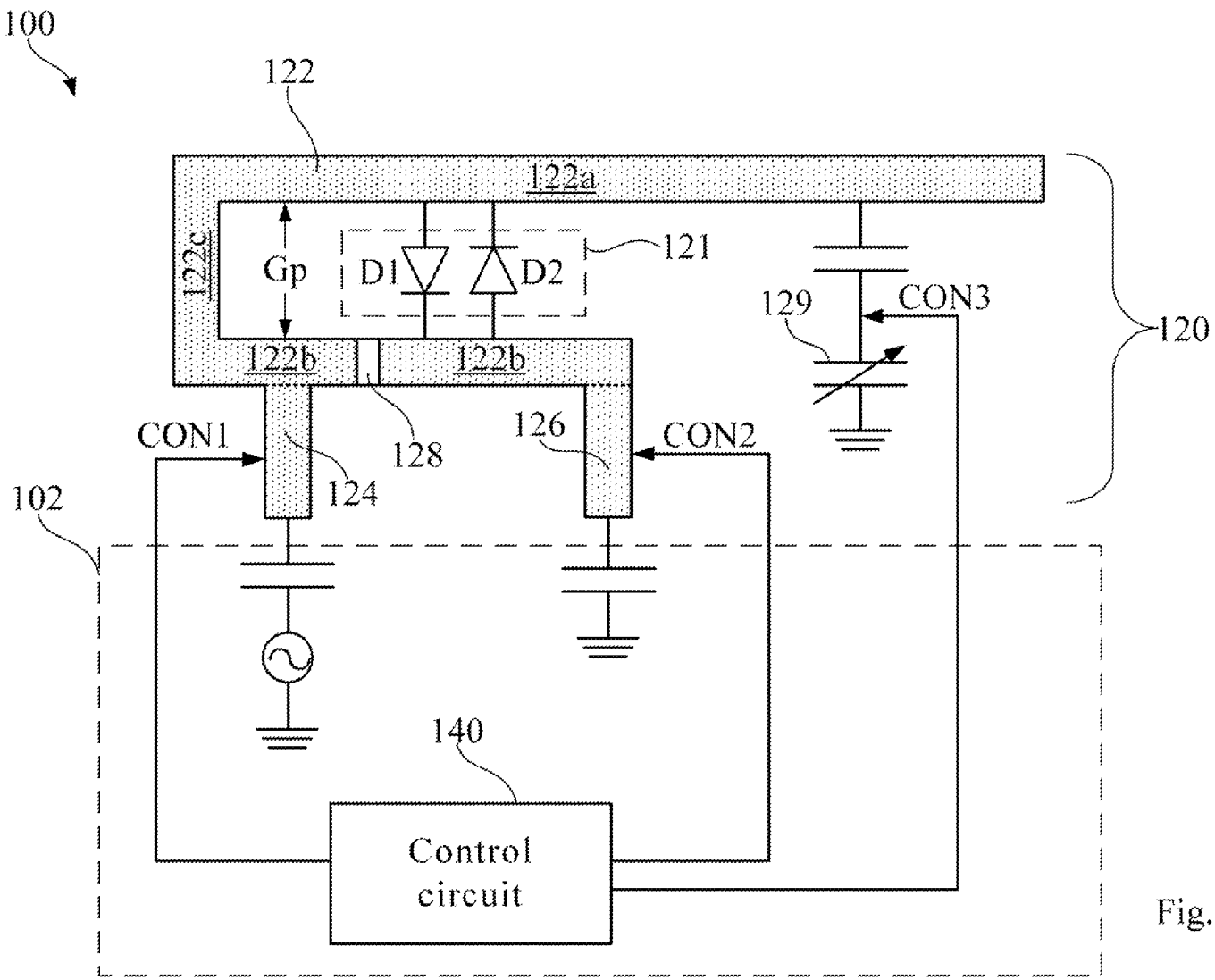
FIG. 1 is a circuit schematic diagram illustrating a portable communication device and an adjustable antenna according to an embodiment of the invention.
Figure 2:
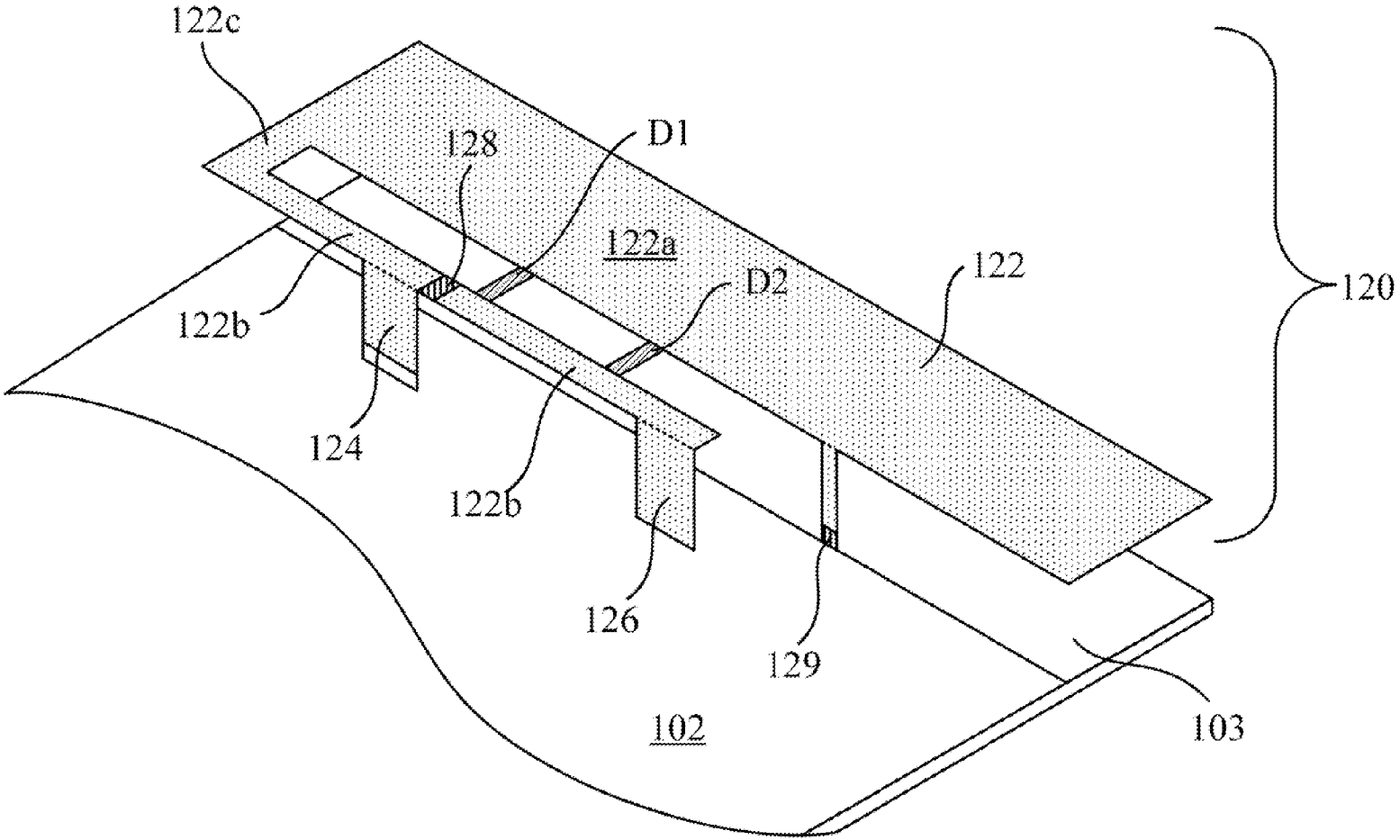
FIG. 2 is a structural diagram illustrating the adjustable antenna in FIG. 1.

Reference is made to FIG. 1 and FIG. 2. FIG. 1 is a circuit schematic diagram illustrating a portable communication device 100 and an adjustable antenna 120 according to an embodiment of the invention. FIG. 2 is a structural diagram illustrating the adjustable antenna 120 in FIG. 1.

As shown in FIG. 1 and FIG. 2, the portable communication device 100 includes a substrate 102, an adjustable antenna 120 and a control circuit 140. In this embodiment, the control circuit 140 is disposed on the substrate 102 of the portable communication device 100, and configured for controlling relative components of the adjustable antenna 120 in order to adjust a frequency band of the adjustable antenna 120. The substrate 102 may include a clearance area 103.

In this embodiment, the adjustable antenna at least includes an antenna body 122, an adjusting element 121, a feeding terminal 124 and a ground terminal 126.

The antenna body 122 is disposed above the substrate 102. In a preferred embodiment, the antenna body 122 is formed in L-shaped and has at least three conductive portions. However, the shape of the antenna body 122 can be changed in correspondence to the practical requirements. In another embodiment, the adjustable antenna may further include an antenna carrier (not shown in figures). In this case, the antenna carrier can be disposed above the substrate 102 and substantial parallel with the substrate 102. The antenna body 102 can be disposed upon the antenna carrier. The carrier can be realized by a flexible circuit board. In another embodiment, the carrier can be a plastic piece. The pattern of the antenna body 122 can be coated on the plastic piece (i.e., the carrier) by Laser Direct Structuring (LDS) manner, but the invention is not limited thereto. In aforesaid embodiments, most of the antenna body 122 shall be disposed above the clearance area 103 in order to obtain better performance of the antenna.

As shown in FIG. 1 and FIG. 2, the antenna body 122 includes a first conductive portion 122*a*, a second conductive portion 122*b* and a third conductive portion 122*c*, which can be made of metal or other conductive materials. The second conductive portion 122*b* is substantially parallel to the first conductive portion 122*a*, and a gap Gp is formed between the first conductive portion 122*a* and the second conductive portion 122*b*. The third conductive portion 122*c* is connected to one end (e.g., the left end in the embodiment of FIG. 1 and FIG. 2) of the first conductive portion 122*a* and one end (e.g., the left end in the embodiment of FIG. 1 and FIG. 2) of the second conductive portion 122*b* respectively.

The adjusting element 121 at least consists of a first diode D1 and a second diode D2. The adjusting element 121 is electrically coupled between the conductive portions. In this case, the first diode D1 is coupled between the first conductive portion 122*a* and the second conductive portion 122*b* and is disposed across the gap Gp. The second diode D2 is coupled between the first conductive portion 122*a* and the second conductive portion 122*b* and is disposed across the gap Gp. In this embodiment, the first diode D1 and the second diode D2 have opposite conductive directions. Two diodes are substantially parallel with each other, and the first diode D1 is located closer to the third conductive portion 122*c* than the second diode D2. However, the relative electrical connecting locations between the diodes and the antenna body 122 and the conductive directions of the diodes can be adaptively adjusted according to different design requirements.

The feeding terminal 124 perpendicularly extends from the second conductive portion 122*b* of the antenna body 122 and is coupled to the substrate 102. The ground terminal 126 perpendicularly extends from the second conductive portion 122*b* of the antenna body 122 and is coupled to the substrate 102.

The control circuit 140 may provide multiple control signals. In this embodiment, the control circuit 140 provides a first control signal CON1 and a second control signal CON2 through the feeding terminal 124 and the ground terminal 126 of the adjustable antenna 120 respectively to the first diode D1 and the second diode D2 of the adjustable antenna 120. The first control signal CON1 and the second control signal CON2 are respectively used for controlling the conductive states of the first diode D1 and the second diode D2, such as to adjust an electrical length of the adjustable antenna 120. It is added that, both of the first control signal CON1 and the second control signal CON2 are direct-current (DC) bias signals, which are configured for controlling DC operational characteristics on the first diode D1 and the second diode D2, and these DC bias signals will not interfere with the antenna transceiving signal on the antenna body 122.

In this embodiment, the adjustable antenna 120 further includes a DC blocking capacitor 128. The DC blocking capacitor 128 is disposed on the second conductive portion 128 of the antenna body 122 and located between the feeding terminal 124 and the ground terminal 126. The DC blocking capacitor 128 is used for restricting the transmission directions of the first control signal and the second control signal and blocking these two control signals.

In this embodiment, the control circuit 140 may set the first control signal and the second control signal in three modes, which include the first and the second control signals being set at the high-level and the low-level (or at the zero-level), at the low-level and the high-level, and at the low-level and the low-level.

When the first control signal CON1 is set at a high-level DC bias voltage (exceeding the threshold voltage of the first diode D1) in the first mode, the first diode D1 is on (i.e., conducted) and the second diode D2 is off (i.e., not conducted). An electrical path of the adjustable antenna 120 starts from the right end of the first conductive portion 122*a* and goes through the first conductive portion 122*a*, the first diode D1 and the second conductive portion 122*b* to the ground terminal 126, such as to form a first electrical length.

When the second control signal CON2 is set at a high-level DC bias voltage (exceeding the threshold voltage of the second diode D2) in the second mode, the second diode D2 is on and the first diode D1 is off. An electrical path of the adjustable antenna 120 starts from the right end of the first conductive portion 122*a* and goes through the first conductive portion 122*a*, the second diode D2 and the second conductive portion 122*b* to the ground terminal 126, such as to form a second electrical length.

When the first/second control signals CON1/CON2 are all set at a low-level (or at the zero-level) DC bias voltage in the third mode (i.e., lower than the threshold voltage of the first/second diode D1/D2), the first diode D1 and the second diode D2 are off in this mode. An electrical path of the adjustable antenna 120 starts from the right end of the first conductive portion 122*a* and goes through the first conductive portion 122*a*, the third conductive portion 122*c* and the second conductive portion 122*b* to the ground terminal 126, such as to form a third electrical length.

In aforesaid embodiment, the third electrical length is longer than the first electrical length, and the first electrical length is longer than the second electrical length. An operating frequency band of the adjustable antenna 120 is inversely proportional to the electrical length. The control circuit 140 feeds the first control signal CON1 and the second control signal CON2 through the feeding terminal 124 and the ground terminal 126 for regulating the electrical length of the adjustable antenna 120, so as to change the operating frequency band on the adjustable antenna 120. In addition, no extra control signal wirings are needed to transmit control signals (e.g., no extra wirings connecting from the substrate 102 to the antenna body 122 or the antenna carrier) for controlling the conductive states of the first diode D1 and the second diode D2.

Figure 3:
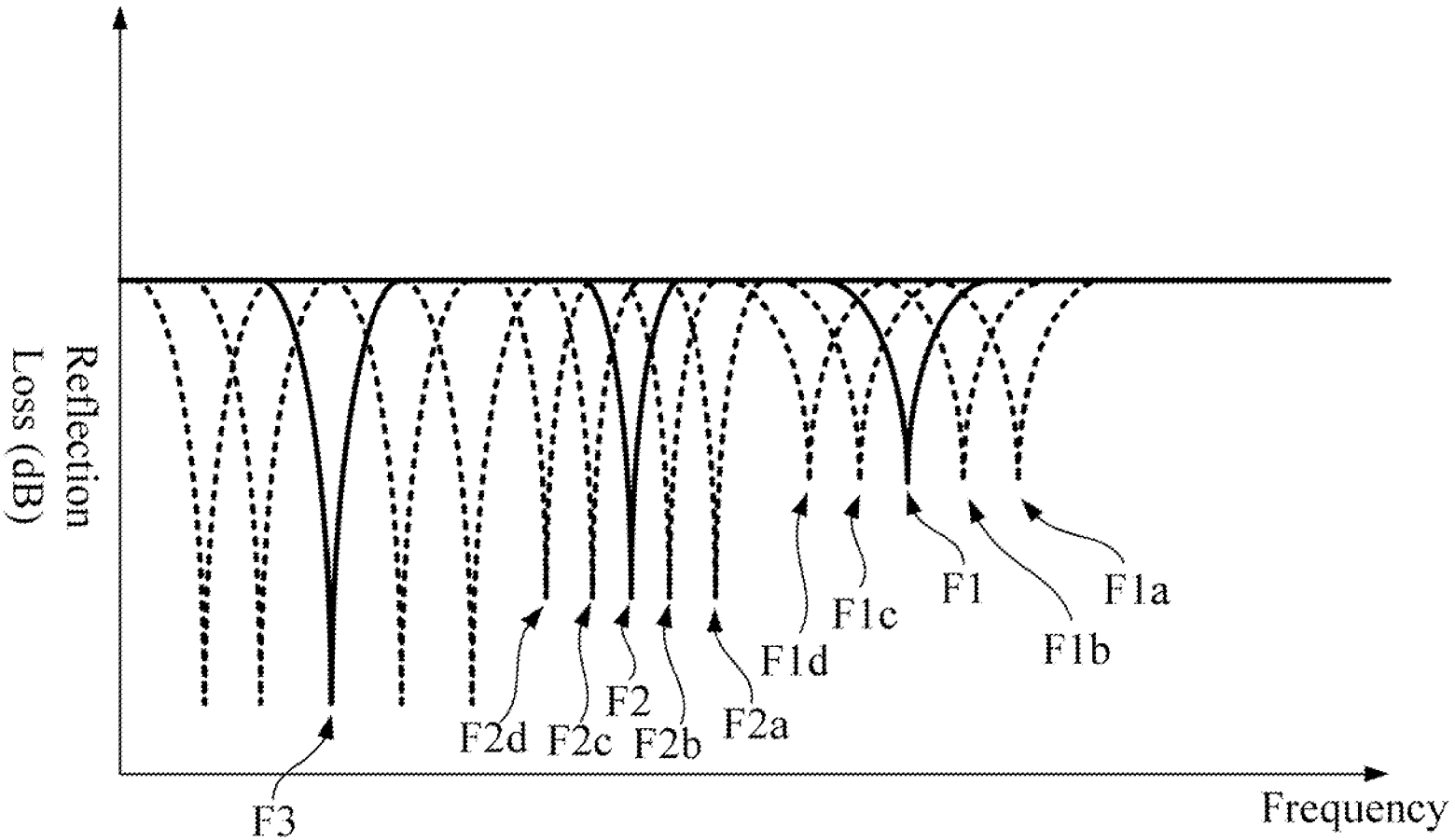
FIG. 3 is a frequency spectrum of the adjustable antenna according to an embodiment of the invention.

Reference is made to FIG. 3, which is a frequency spectrum of the adjustable antenna 120 according to an embodiment of the invention. As shown in FIG. 3, the control circuit 140 may control the conductive states of the first diode D1 and the second diode D2 and selectively sets a center of the operating frequency band of the adjustable antenna 120 onto one of different operating frequency bands (F1, F2 or F3). The shortest electrical length (the second electrical length) corresponds to the high operating frequency band F1. The longest electrical length (the third electrical length) corresponds to the low operating frequency band F3. In this case, the adjustable antenna 120 can be adjusted dynamically and covers a larger range of frequency band.

In addition, as shown in FIG. 1 and FIG. 2, the adjustable antenna 120 may further include a variable capacitive loading 129, which is coupled with the first conductive portion 122*a* of the antenna body 122. The control circuit further generate a third control signal CON3 for controlling a capacitance value $C_d$ of the variable capacitive loading 129, such as to regulate a plurality of working frequencies of the adjustable antenna 120 within each of the operating frequency band. The capacitance value $C_d$ is configured between $C_{Max}$ and $C_{Min}$, and $C_{Max}$ is about 3 times of $C_{Min}$. However, the ratio between them can be re-adjusted according to practical requirements.

As shown in FIG. 3, after the control circuit 140 selects the operating frequency band F1 by utilizing the first control signal CON1 and the second control signal CON2, the control circuit 140 may further perform a minor adjustment continuously within the operating frequency band F1 by utilizing the third control signal CON3, such that the adjustable antenna 120 can be operated at different operating working frequencies, e.g., F1*a*, F1*b*, F1*c*, or F1*d*.

When the capacitance value $C_d$ of the variable capacitive loading 129 is set at the $C_{Min}$, the adjustable antenna 120 may correspond to the operating frequency F1*a*; when the capacitance value $C_d$ of the variable capacitive loading 129 is set at the $C_{Max}$, the adjustable antenna 120 may correspond to the operating frequency F1*d*. Because the capacitance value $C_d$ of the variable capacitive loading 129 is a consecutive numerical, the adjustable antenna 120 may has a smooth and uninterrupted available bandwidth when the capacitor value $C_d$ is adjusted continuously to change the operating frequency of the adjustable antenna 120. Therefore, the performance of the adjustable antenna 120 can be maintained at best performance in the whole operating frequency bands.

It is understood that, if the operating frequency band F2 is selected at first, the third control signal can further be utilized to perform a minor adjustment continuously within the operating frequency band F2. When the capacitance value $C_d$ is set at the $C_{Min}$, the adjustable antenna 120 may correspond to the operating frequency F2*a*; when the capacitance value $C_d$ of the variable capacitive loading 129 is set at the $C_{Max}$, the adjustable antenna 120 may correspond to the operating frequency F2*d*. Based on aforesaid explanations, the adjustable antenna 120 may has a smooth and uninterrupted available bandwidth within the operating frequency band F2.

In addition, the working frequency F1*d* within the operating frequency band F1 is overlapped with the working frequency F2*a* within the operating frequency band F2. In other words, the frequency spectrums of the operating frequency band F1 and the operating frequency band F2 are continuous between different bands. When the portable communication device is handover or roaming between different bands for telecommunications, the adjustable antenna 120 has a smooth and uninterrupted available bandwidth, which is wider than one regular frequency band, such as to cover operating bands of multiple systems (e.g., GSM, Wi-Fi, WiMax, LTE, etc). For the same reason, the frequency spectrums of the operating frequency band F2 and the operating frequency band F3 are also continuous. Therefore, the overall operating bandwidth of the adjustable antenna 120 covers from the low-frequency band F3 to the high-frequency band F1, and the bandwidth of the adjustable antenna 120 is a smooth and uninterrupted available bandwidth. Therefore, the adjustable antenna has two stages in adjustment such as to precisely correspond to different requirements of frequency bands.

Figure 4:
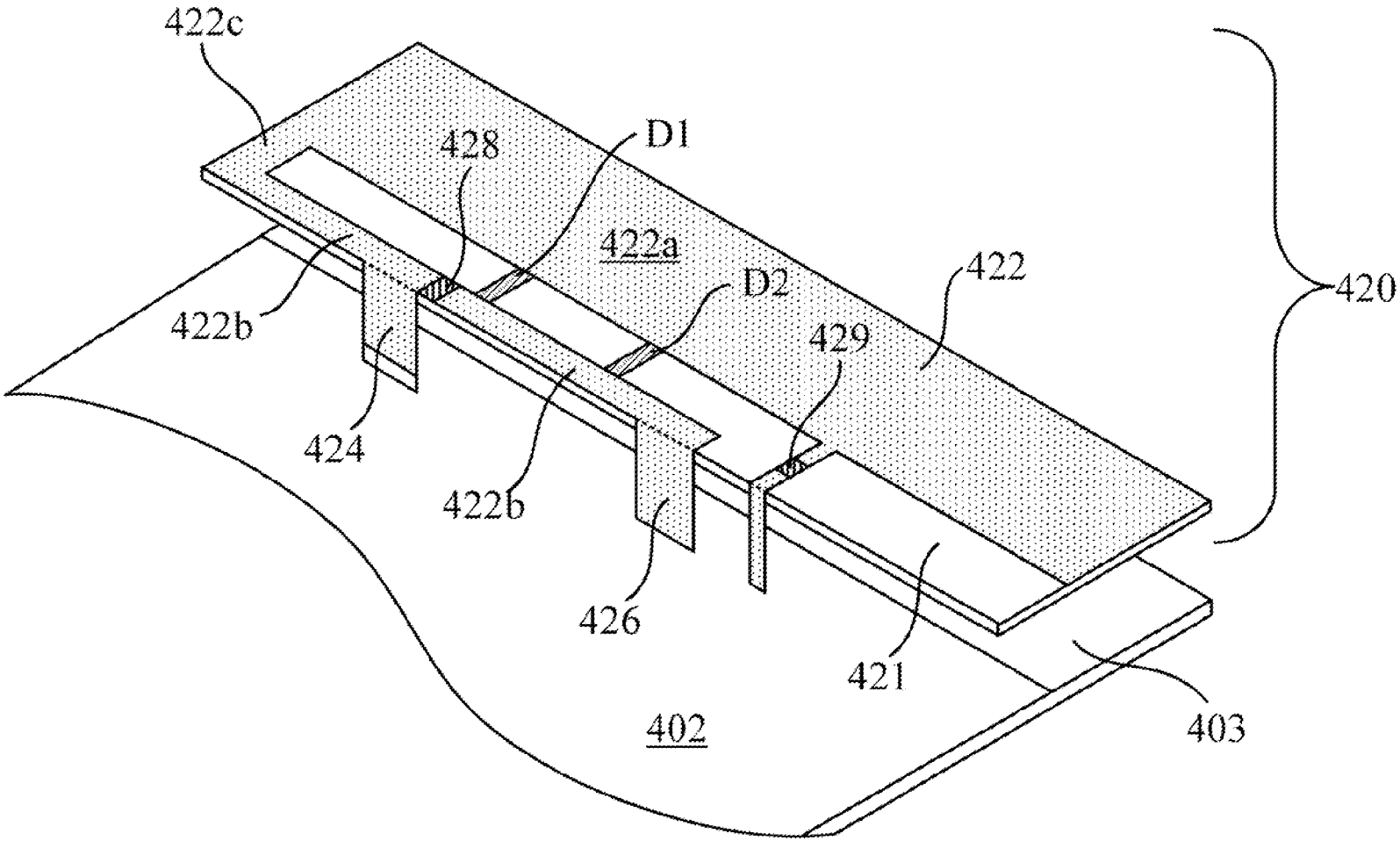
FIG. 4 is a structural diagram illustrating an adjustable antenna according to another embodiment.

Reference is made to FIG. 4, which is a structural diagram illustrating an adjustable antenna 420 according to another embodiment. In comparison to embodiment shown in FIG. 2, the antenna body 422 and related components of the adjustable 420 in embodiment shown in FIG. 4 are disposed on a carrier 421. The carrier 421 is disposed above the substrate 402 and substantially parallel with the substrate 402. The detail operations and implementation of other components of embodiment in FIG. 4 are similar to the aforesaid embodiment shown in FIG. 2, and not to be repeated herein.

Figure 5:
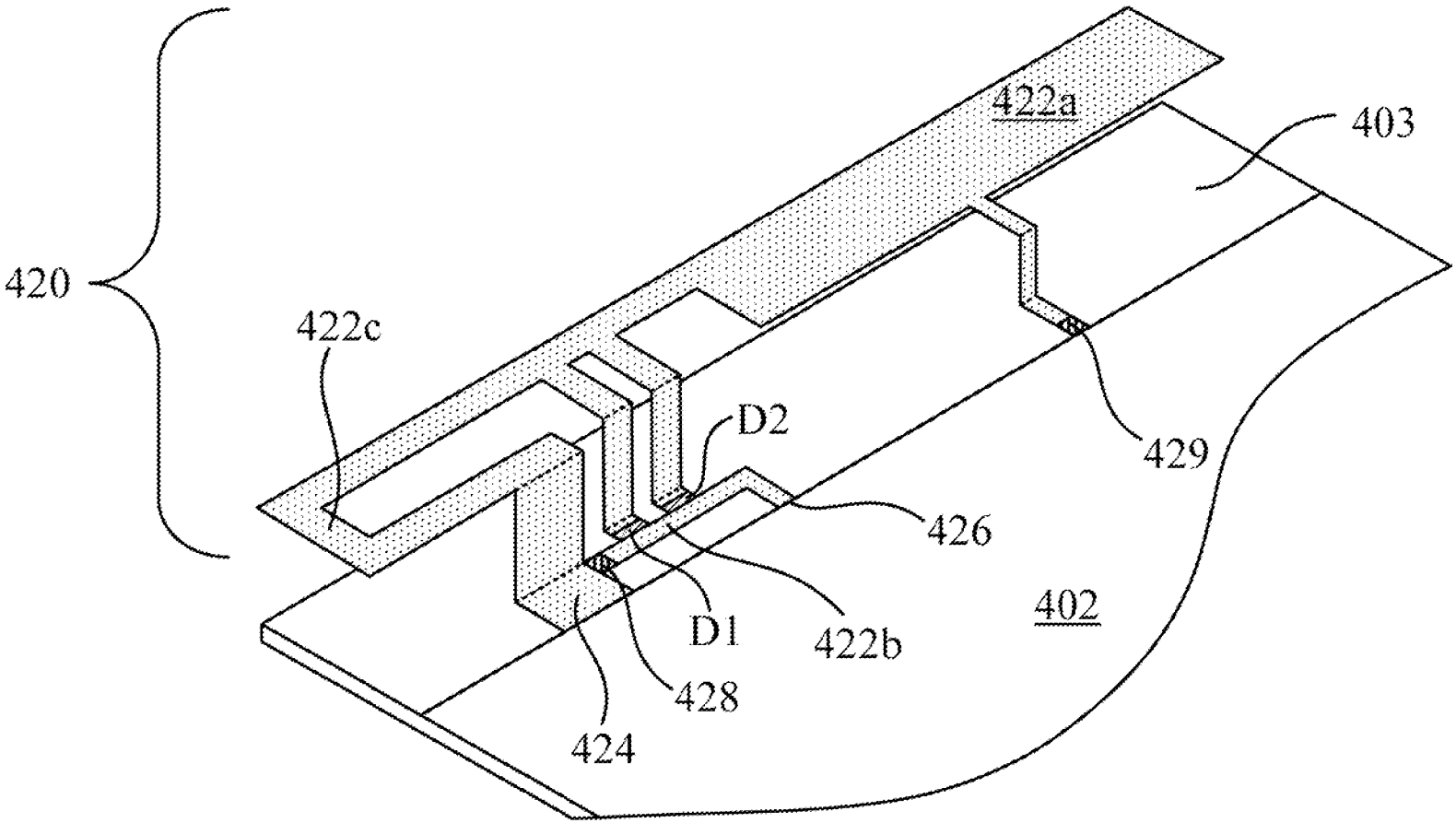
FIG. 5 is a structural diagram illustrating an adjustable antenna according to another embodiment.

Reference is made to FIG. 5, which is a structural diagram illustrating an adjustable antenna 420 according to another embodiment. In comparison to embodiment shown in FIG. 2, in the adjustable antenna 420 of embodiment shown in FIG. 5, a part of the second conductive portion 422*b*, the feeding terminal 424, the ground terminal 426, the first diode D1, the second diode D2, the DC blocking capacitor 428 and the variable capacitive loading 429 are directly disposed on the substrate 402. The components of the adjustable antenna 420 are all located within the clearance area 403 of the substrate 402. The detail operations and implementation of other components of embodiment in FIG. 5 are similar to the aforesaid embodiment shown in FIG. 2, and not to be repeated herein.

Based on aforesaid embodiments, this disclosure provides a portable communication device and an adjustable antenna thereof. There is an adjusting element (the adjusting element may include two diodes with opposite conductive directions) disposed in the adjustable antenna. Control signals can be fed through a feeding terminal and a ground terminal of the adjustable antenna for controlling the adjusting element (e.g., controlling the conductive states of the diodes), such that an electrical length of the adjustable antenna can be regulated for adjusting frequency on the antenna. In addition, the adjustable antenna may further include a variable capacitive loading, and a capacitance value of the variable capacitive loading can be controlled by a direct-current (DC) biased control signal fed through the feeding terminal, such that the frequency adjustment can be controlled in a smooth and continuous manner. In this case, the frequency adjustment on this adjustable antenna can be realized without extra control signal wirings for transmitting control signals.

It will be apparent to those skilled in the art that various modifications and variations can be made to the structure of the present application without departing from the scope or spirit of the application. In view of the foregoing, it is intended that the present application cover modifications and variations of this application provided they fall within the scope of the following claims.

What is claimed is:

1. A portable communication device, comprising:

a substrate;

an adjustable antenna, comprising:

an antenna body having a plurality of conductive portions, and the antenna body being disposed above the substrate;

an adjusting element coupled between the conductive portions;

a feeding terminal extending from the antenna body and coupled to the substrate; and a ground terminal extending form the antenna body and coupled to the substrate;

a control circuit configured for feeding a first control signal and a second control signal respectively through the feeding terminal and the ground terminal to the adjusting element, so as to adjust an electrical length of the adjustable antenna.

2. The portable communication device of claim 1, wherein the adjusting element at least comprises a first diode and a second diode.

3. The portable communication device of claim 2, wherein the first diode is located closer to the feeding terminal than the second diode.

4. The portable communication device of claim 2, wherein each of the first control signal and the second control signal is a direct-current (DC) bias signal configured for controlling the conductive states of the first diode and the second diode respectively.

5. The portable communication device of claim 4, wherein the electrical length of the adjustable antenna in a path through the first diode is set at a first electrical length when the first diode is on and the second diode is off, the electrical length of the adjustable antenna in a path through the second diode is set at a second electrical length when the first diode is off and the second diode is on, the electrical length of the adjustable antenna in a path through a third conductive portion of the antenna body is set at a third electrical length when both of the first diode and the second diode are off, the third electrical length is longer than the first electrical length, and the first electrical length is longer than the second electrical length.

6. The portable communication device of claim 4, wherein the first diode and the second diode have opposite conductive directions.

7. The portable communication device of claim 1, wherein the adjustable antenna further comprises a direct-current (DC) blocking capacitor disposed on antenna body and located between the feeding terminal and the ground terminal for blocking the first control signal and the second control signal.

8. The portable communication device of claim 1, wherein the conductive portions comprise a first conductive portion, a second conductive portion and a third conductive portion, the second conductive portion is parallel to the first conductive portion and a gap is formed therebetween, the third conductive portion is connected to one end of the first conductive portion and one end of the second conductive portion respectively, and the adjusting element is coupled between the first conductive portion and the second conductive portion and is disposed across the gap.

9. The portable communication device of claim 8, wherein each of the feeding terminal and the ground terminal extends from the second conductive portion and is coupled to the substrate.

10. The portable communication device of claim 8, wherein the feeding terminal, the ground terminal, the adjusting element and at least a part of the second conductive portion are disposed on the substrate.

11. The portable communication device of claim 10, wherein the adjustable antenna further comprises a direct-current (DC) blocking capacitor disposed on the substrate and located between the feeding terminal and the ground terminal for blocking the first control signal and the second control signal.

12. The portable communication device of claim 11, further comprising a variable capacitive loading disposed on the substrate, the variable capacitive loading being coupled with the first conductive portion, and the control circuit further feeding a third control signal for controlling a capacitance value of the variable capacitive loading.

13. The portable communication device of claim 12, wherein the substrate further comprises a clearance area, the antenna body, the feeding terminal, the ground terminal, the adjusting element, the DC blocking capacitor and the variable capacitive loading are directly disposed within the clearance area.

14. The portable communication device of claim 1, wherein the control circuit changes an operating frequency band of the adjustable antenna by adjusting the electrical length of the adjustable antenna, wherein the operating frequency band is inversely proportional to the electrical length.

15. The portable communication device of claim 14, further comprising a variable capacitive loading coupled with the antenna body, and the control circuit further feeding a third control signal for controlling a capacitance value of the variable capacitive loading, so as to continuously adjust a plurality of working frequencies within the operating frequency band.

16. The portable communication device of claim 1, wherein the adjustable antenna further comprises a carrier disposed above the substrate and substantially parallel with the substrate, the antenna body is disposed on the carrier.

17. The portable communication device of claim 1, wherein the substrate further comprises a clearance area, most of the antenna body is disposed above the clearance area.

18. An adjustable antenna, suitable for a portable communication device comprising a substrate, the adjustable antenna comprising:

an antenna body having a plurality of conductive portions, the antenna body being disposed above the substrate;

a first diode coupled between the conductive portions;

to a second diode coupled between the conductive portions;

a feeding terminal extending from the antenna body and coupled to the substrate; and a ground terminal extending form the antenna body and coupled to the substrate, wherein the first diode is located closer to the feeding terminal than the second diode, the first diode and the second diode have opposite conductive directions, and each of a first control signal and a second control signal is respectively fed through the feeding terminal and the ground terminal to the adjustable antenna for controlling conductive states of the first diode and the second diode, so as to adjust an electrical length of the adjustable antenna.

* * * * *